US006945304B1

(12) United States Patent
Kleynjans

(10) Patent No.: US 6,945,304 B1
(45) Date of Patent: Sep. 20, 2005

(54) FLEXIBLE-STRIP HANGER FOR A STRIP DOOR SYSTEM AND METHOD OF MAKING

(75) Inventor: Joseph Peter Kleynjans, Coraopolis, PA (US)

(73) Assignee: TMI Incorporated, Pittsburgh, PA (US)

( * ) Notice: Subject to any disclaimer, the term of this patent is extended or adjusted under 35 U.S.C. 154(b) by 113 days.

(21) Appl. No.: 10/406,527

(22) Filed: Apr. 3, 2003

(51) Int. Cl.[7] ..... A47H 23/05
(52) U.S. Cl. ..... 160/332; 160/184
(58) Field of Search ..... 160/332, 184, 160/405, 327, 328, 383, 398, 404, 392, 395; 24/716; 264/37.27, 37.3, 177.19, 328.1, 328.14, 264/453, 478, 513, 537, 645

(56) References Cited

U.S. PATENT DOCUMENTS 3,822,734 A * 7/1974 Tombu ..... 160/383
3,833,046 A * 9/1974 Tombu ..... 160/327
4,053,008 A * 10/1977 Baslow ..... 160/327
4,165,778 A 8/1979 Smith ..... 160/332
4,197,686 A * 4/1980 Baslow ..... 52/273
4,312,396 A * 1/1982 McKinnon et al. ..... 160/332
4,403,642 A * 9/1983 Morris ..... 160/380
4,625,490 A * 12/1986 Baslow ..... 52/717.05
4,676,016 A * 6/1987 Phillips et al. ..... 40/617
5,127,460 A 7/1992 Abadi et al. ..... 160/332
6,050,322 A * 4/2000 Finkelstein et al. ..... 160/332

* cited by examiner

*Primary Examiner*—David Purol
(74) *Attorney, Agent, or Firm*—Armstrong, Kratz, Quintos, Hanson & Brooks, LLP

(57) ABSTRACT

A single-piece molded plastic hanger for flexible plastic strips of a strip door system having a backing-plate portion and a cover portion connected with a continuous hinge portion. The backing-plate portion is mountable to a header of an opening and supporting studs and locking studs of the backing-plate portion engage apertures of the flexible strips to support them in a vertically hanging manner. The cover portion retains the hanging strips on the supporting studs and locking studs and the cover portion is held in a closed condition by engagement of the locking studs with the cover portion. Replacement of flexible strips is easily carried out manually without the use of hand tools, or the like.

11 Claims, 6 Drawing Sheets

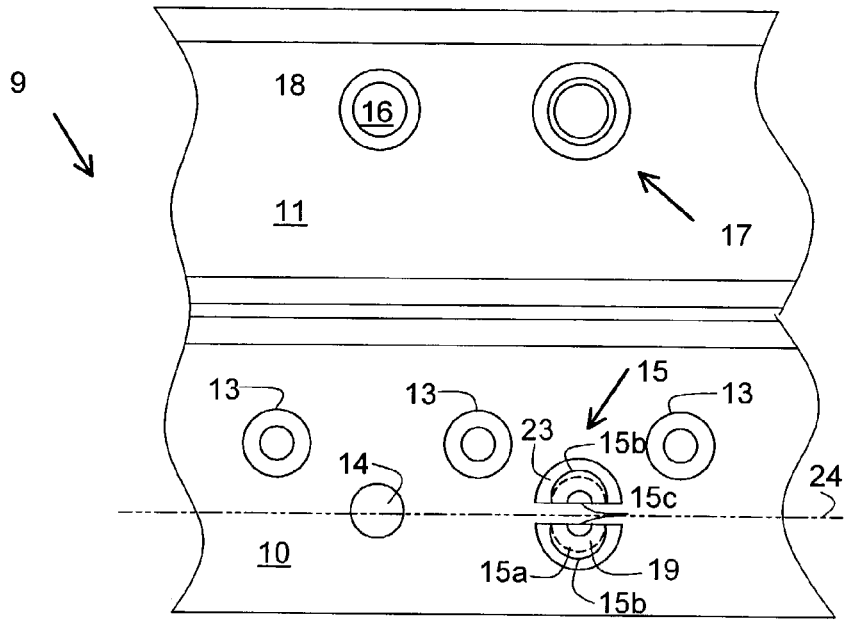
FIG. 6
FIG. 7
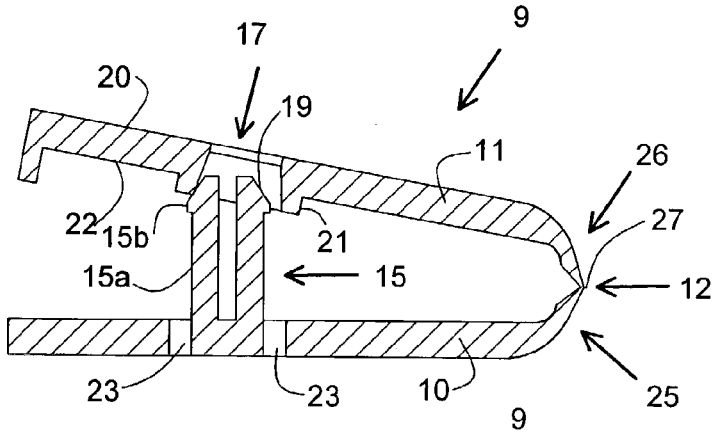
FIG. 8
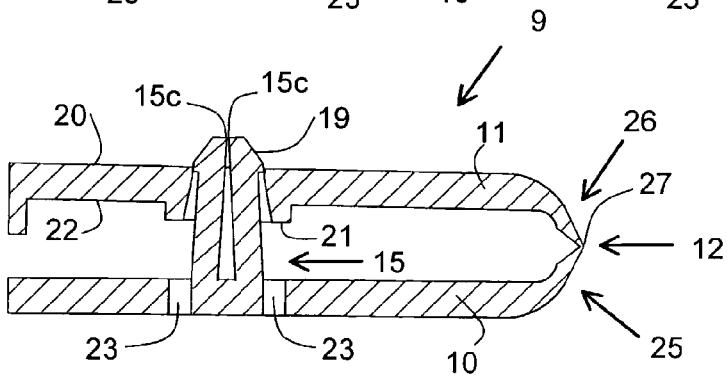

FLEXIBLE-STRIP HANGER FOR A STRIP DOOR SYSTEM AND METHOD OF MAKING

FIELD OF THE INVENTION

The present invention relates to the field of strip doors used for providing a barrier, in a vertical plane, to the movement of air, liquids, vapors, particulate matter, insects, etc., while allowing for substantially free movement of personnel, equipment, product, or the like through the barrier.

BACKGROUND OF THE INVENTION

Strip door systems, having a plurality of vertically hanging flexible strips with longitudinal edges in either abutting or overlapping arrangement, are used in many varied applications as a barrier in a vertical plane, to the movement of air or other matter, while still allowing for substantially free movement of personnel, equipment, product, or the like through the barrier by simply parting and/or bending the hanging flexible strips. Examples of where strip door systems are utilized include: entryways into coolers, freezers, heated/cooled rooms, and processing areas; openings of product display cases in supermarkets; and areas within a production facility at which fumes, particulate matter, liquid droplets, noise, etc. are to be contained. In an often used application in the food industry, the use of strip door systems as a barrier to the movement of air across a selected vertical plane, such as a doorway to a cooler or a freezer, can lead to a substantial savings in heating and/or cooling costs and reduce premature food spoilage.

Strip door systems typically are made up of a plurality of flexible plastic strips, often clear so as to provide a see-through feature, having a width in a range of 4–16 inches, a thickness in a range of 0.060 to 0.160 inches, and a length which can vary from several inches to any length required to provide the desired barrier. The flexible plastic strips are preferably hung from hangers having a series of evenly spaced horizontally projecting studs. With use of a hanger having projecting studs, evenly spaced apertures, which correspond to the spacing of the evenly spaced studs, are provided along a top edge portion of each strip and the strips are easily arranged on the hanger by inserting the studs through the apertures. The stud-type hanger system is preferred as the strips can be arranged to have a pattern ranging from one in which longitudinal edges of the strips abut each other, to a pattern in which portions of the strips overlap each other. With the stud-type hanger system, the overlap can be selected, in general, to be in any increment corresponding to the spacing of the studs. An advantage of the stud-type hanger system is realized when replacement of a few of the strips is necessary, as only the strips to be replaced need to be removed, while not disturbing the remaining strips. Depending on the amount of usage and the type of equipment passing through the barrier formed by the hanging strips, replacement of individual strips is usually required over the life of the flexible strip door system.

Various stud-type hangers are known in the industry for hanging the flexible plastic strips of the system. In a walk-in cooler or freezer, for example, a back portion of a hanger can be mounted to a header of an entryway to the cooler or freezer using some form of fastening means. The flexible plastic strips, having apertures with a spacing corresponding to the spacing of studs protruding from the back portion of the hanger, are slid over the studs using a selected abutting or overlap pattern for the strips. Next, a means for retaining the strips on the studs is installed. Installation of most known retaining means to the back portion of the hanger requires tedious alignment of the retaining means with the back portion of the hanger, then securing the retaining means to the back portion of the hanger with the use of fasteners and various hand tools.

OBJECTS OF THE INVENTION

It is an object of the present invention to provide a hanger for flexible strips of a strip door system which is easily attached to a header of an entryway to support the flexible strips in a manner that prevents unwanted removal of the strips from the hanger.

It is another object of the present invention to provide a means for retaining the strips on the studs which can be installed and removed manually without the use of separate fasteners or hand tools.

It is a further object of the present invention to provide a self aligning means for aligning the strip retaining means with the strip-supporting portion of the hanger following installing or replacing the flexible strips.

It is still a further object of the present invention to provide a hanger having generally smooth surfaces so as to provide a system which is easily kept in a clean sanitary condition.

It is still another object of the present invention to provide a hanger having a low profile in relation to components extending outwardly from a mounting surface such as a header.

SUMMARY OF THE INVENTION

The present invention is a single-piece molded plastic hanger, for use in a strip door system for providing a barrier for an opening. The hanger supports vertically oriented flexible plastic strips, each strip having a row of uniformly spaced apertures along an end portion. The single-piece molded plastic hanger has an elongated backing-plate portion for attaching the hanger to a header of the opening. The backing-plate portion has a plurality of means for supporting the vertically hanging plastic strips. An elongated cover portion, when closed, retains the hanging strips on the supporting means. A hinge portion connects a longitudinal edge of the backing-plate and a longitudinal edge of the cover portion to enable movement of the cover portion to an open and closed condition. The supporting means engage the cover portion when the cover portion is in a closed condition and removal of the cover portion from locking studs is prevented.

DESCRIPTION OF THE DRAWINGS

The invention will become more readily apparent from the following description of preferred embodiments thereof shown, by way of example only, in the accompanying drawings wherein:

FIG. 6 is an enlarged front view of a portion the hanger of the present invention in a fully open condition;

FIG. 7 is an enlarged sectional view of the hanger of the present invention in a partially closed condition, in a plane indicated at 7–7 of FIG. 4;

FIG. 8 is an enlarged sectional view of the hanger of the present invention in another partially closed condition, in a plane indicated as 7–7 of FIG. 4;

DETAILED DESCRIPTION

Figure 1:
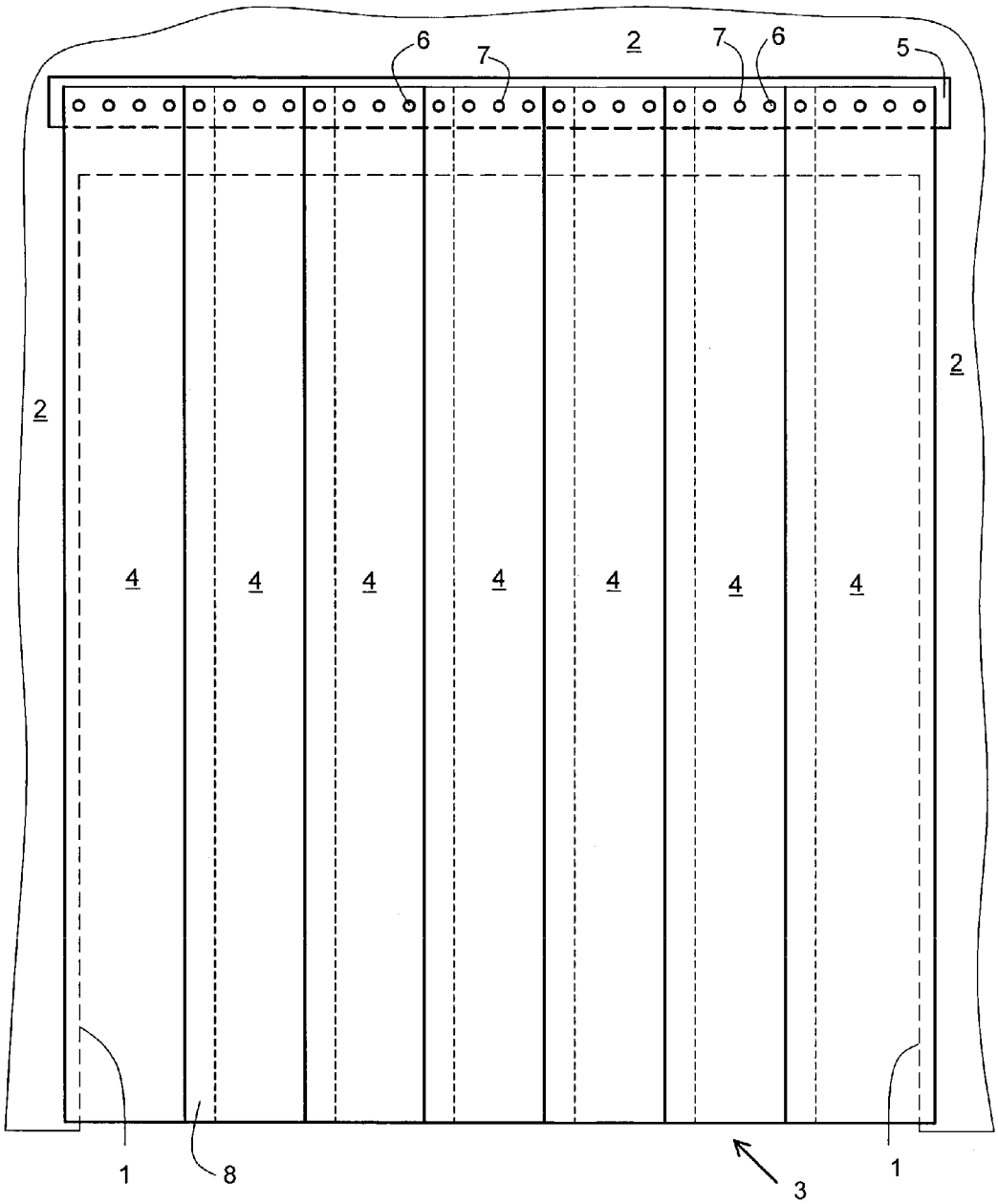
FIG.1 Prior Art
FIG. 1 is a prior-art strip door system wherein flexible plastic strips having uniformly spaced apertures are supported on a hanger having uniformly spaced protruding studs.

FIG. 1 depicts a strip door system, which is known in the industry, wherein flexible plastic strips are used to provide a barrier in a vertical plane. In FIG. 1, entryway 1 in wall 2 is provided with a barrier to air flow, for example, with use of a strip door system 3. Use of strip door system 3 allows workers to easily pass through the entryway, either on foot or a fork lift, for example, by merely briefly separating vertically hanging flexible plastic strips 4 and/or bending the strips upwardly or sideways to create an opening.

A preferred method of hanging the flexible plastic strips is to provide a hanger 5 having uniformly spaced studs 6 extending outwardly in a substantially horizontal orientation. The flexible plastic strips 4 are each provided with uniformly spaced apertures 7, along a top end portion of the strip, having a spacing corresponding to the spacing of the studs 6 of the hanger 5. Installation of the strips is carried out by sliding apertures 7 of the strips 4 over the studs 6. Such a system allows for many strip patterns ranging from a pattern having longitudinal edges of the strips abutting longitudinal edges of adjacent strips, to a strip pattern having the strips overlap each other to an extent where a double thickness of the strips is provided across the width of the opening 1. In the installation depicted in FIG. 1, an overlap of about 25% of the width of a strip is shown at 8. In general the overlap amount is a multiple of the spacing of the studs and the apertures. Following installation of the strips over the studs, a cap or other means must be provided to prevent the strips from sliding off the ends of the studs.

Figure 2:
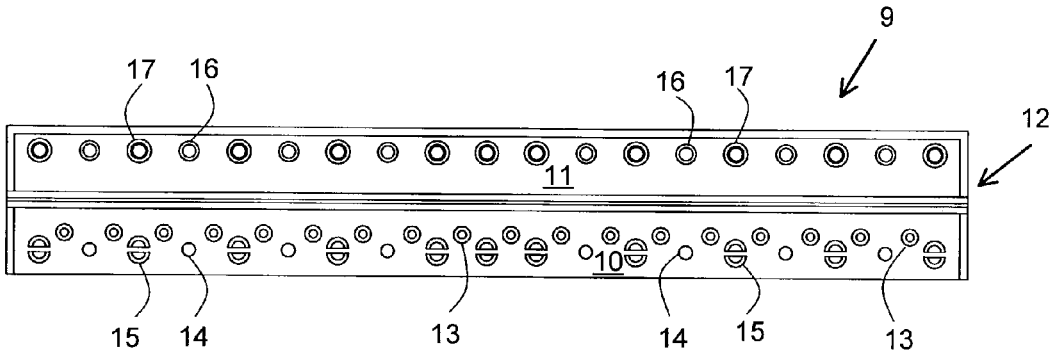
FIG. 2 is a front view of a hanger of the present invention in a fully opened condition.

The present invention is a hanger, for use in a strip door system, which enables installing or replacing flexible plastic strips in a quick and efficient manner. Referring to FIG. 2, the invention is a single-piece molded plastic hanger 9 preferably formed of a polypropylene material by injection molding. The hanger has an elongated backing-plate portion 10, an elongated cover portion 11, and a hinge portion 12 connecting a longitudinal edge of the cover portion to a longitudinal edge of the backing-plate portion. In FIG. 2 the hanger is shown in a fully open condition.

Figure 3:
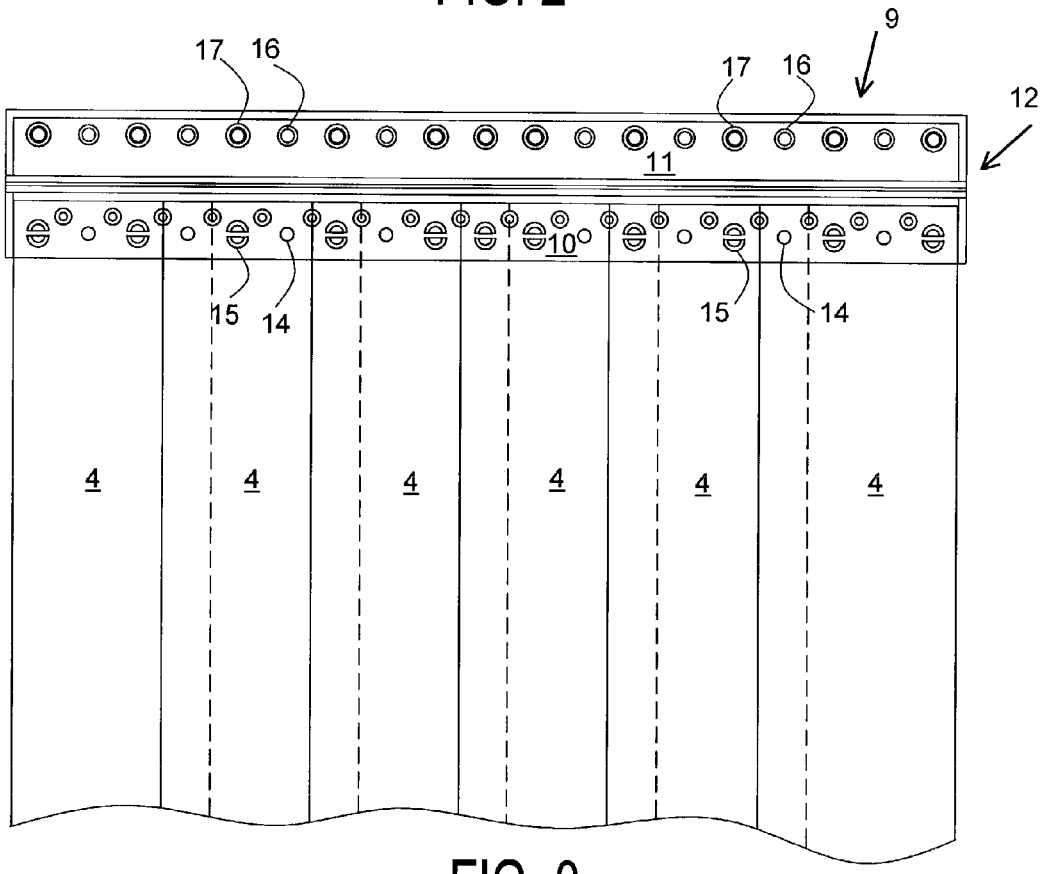
FIG. 3 is a front view of the hanger of the present invention in a fully open condition with flexible plastic strips in place on studs and locking studs of the hanger.
Figure 4:
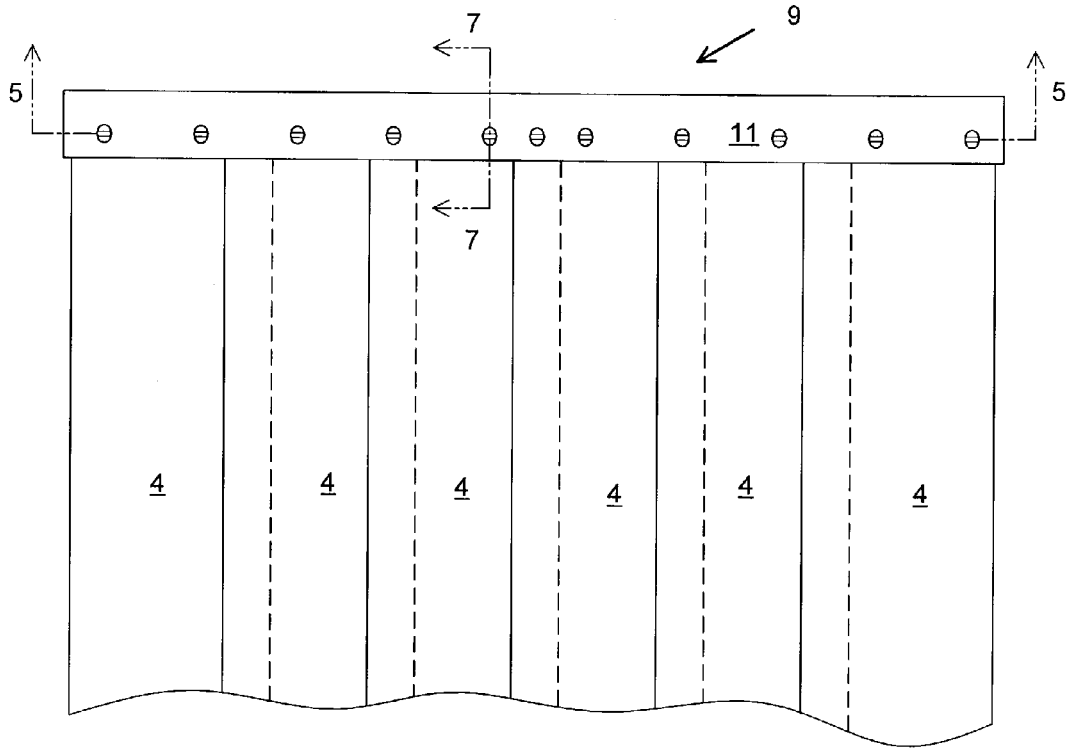
FIG. 4 is a front view of the hanger of the present invention in a fully closed condition with flexible plastic strips supported by studs and locking studs of the hanger.

FIG. 3 shows hanger 9 of the present invention having flexible plastic strips 4 installed and the cover portion 11 in the fully opened condition, and FIG. 4 shows hanger 9 having flexible plastic strips 4 installed and the cover portion 11 in the fully closed condition, so as to provide a means for holding the strips in place on the hanger.

As shown in FIG. 2, hanger 9 provides apertures 13 for use in mounting backing-plate portion 10 of the hanger, for example, to a header of an entryway of a walk-in cooler. In a preferred embodiment, apertures 13 are counter sunk to the face of the backing-plate portion 10 in order that flat-head wood screws or flat-head machine screws can be used as fasteners and a substantially planar surface on the backing-plate portion remains for contacting a generally planar surface of the flexible strips being supported. Uniformly spaced, in line, along the backing-plate portion 10, at a spacing corresponding to the spacing of apertures in the flexible strips to be supported, are supporting studs 14 and locking studs 15. The supporting studs 14 and locking studs 15 can be alternated along the backing-plate, or arranged otherwise to achieve certain objectives.

In elongated cover portion 11, are receiving means, such as receiving recesses 16 and receiving apertures 17, for slidingly receiving the supporting studs 14 and locking studs 15 respectively, having a spacing corresponding to that of the supporting studs 14 and locking studs 15. When the hanger is in a closed condition, the elongated cover portion 11 generally overlays the elongated backing-plate portion 10 and the supporting studs 14 and locking studs 15 are engaged with the receiving recesses 16 and receiving apertures 17 respectively.

To facilitate closing the cover portion of the hanger, by assuring alignment of all of the components, hinge portion 12 hingeably connects a longitudinal edge of the backing plate portion 10 and a longitudinal edge of the cover portion 11.

As mentioned above, the preferred embodiment of the invention is a single piece of polypropylene, which is injection molded. The configuration of the hinge and the specific method of molding, which are discussed below, are important features of the invention, as a hinge which will provide extended service at temperatures such as those found in freezers is difficult to produce, especially in view of the length of a hanger used for entryways having a width of 30 inches or more.

Figure 5:
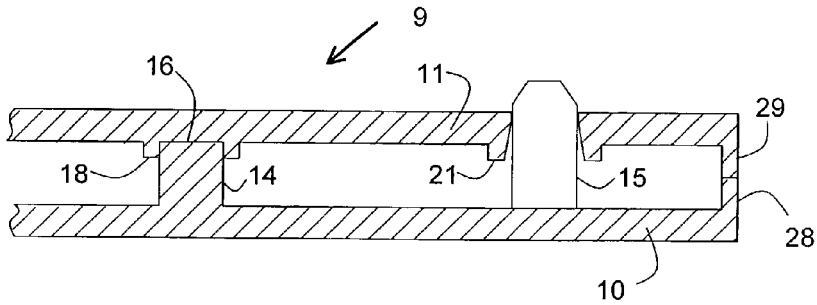
FIG. 5 is an enlarged sectional view of an end portion of the hanger of the present invention in a fully closed condition, in plane 5–5 as indicated in FIG. 4.

The supporting studs 14 and locking studs 15, as well as receiving recesses 16 and receiving apertures 17, are shown in detail in the enlarged views of FIGS. 5–10. Stud 14 is preferably cylindrical in shape and extends outwardly perpendicularly from backing-plate portion 10. When the hanger 9 is mounted horizontally to a vertical surface of a header above an entryway, for example, supporting studs 14 extend outwardly from the backing-plate portion 10 with a central axis of the cylinder shape having a substantially horizontal orientation. The supporting studs 14 are of a length to extend into the cylindrically shaped receiving recesses 16 in the cover portion 11 when the cover portion is closed as shown in FIG. 5. FIG. 5 is an enlarged sectional view of an end portion of the hanger in a plane 5—5 as shown in FIG. 4. The receiving recesses 16 can extend into the inner face of the cover portion 11, however additionally a reinforcing annular rib 18 is preferably provided, as shown in FIG. 5, to assure that supporting stud 14 is slidingly engaged with a receiving recess 16 in the cover portion 11.

Figure 9:
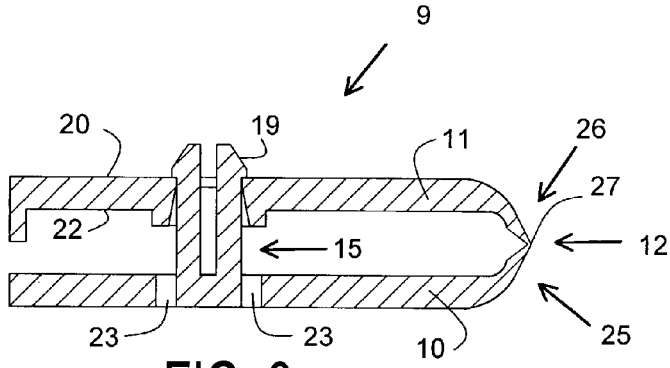
FIG. 9 is an enlarged sectional view of the hanger of the present invention in a fully closed condition, in a plane indicated at 7–7 of FIG. 4.
Figure 10:
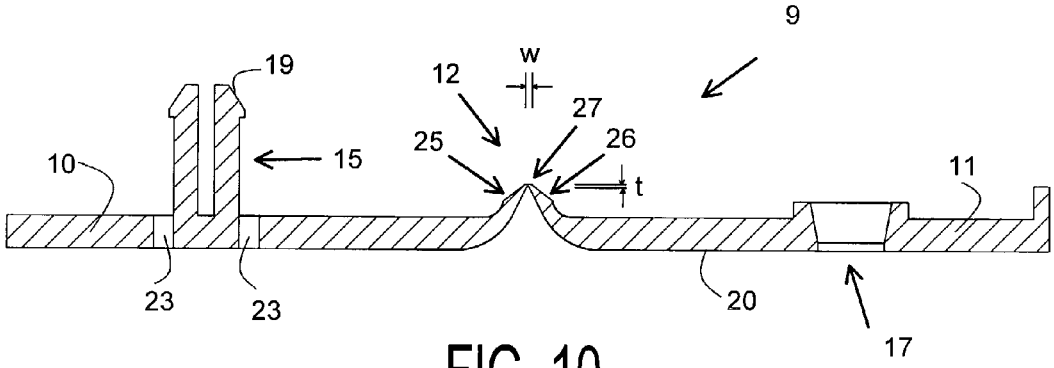
FIG. 10 is an enlarged sectional view of the hanger of the present invention in a fully open condition, in a plane indicated at 7–7 of FIG. 4.

Locking studs 15, in addition to supporting the hanging flexible strips in a manner similar to the supporting studs 14, are also used to engage and restrain the cover portion 11 in the closed condition. The restrainment is of a level which keeps the cover in place and prevents the flexible strips from sliding off the supporting studs and locking studs, but is not so great as to prevent releasing of the cover to an open condition when service is required, by manually grasping the cover and rotating it upwardly about the hinge portion, without the use of hand tools or other prying means. As best viewed in FIG. 9, when cover portion 11 is in a closed condition, a generally oval head portion 19 of locking stud 15 partially overlaps a front surface 20 of cover portion 11. Such overlapping engagement restrains cover portion 11 in the closed condition. Referring to FIG. 6, an enlarged front view of a portion of the hanger in a fully opened condition, generally oval-shaped head portion 19, has a major axis of its oval shape which is greater than the diameter of receiving aperture 17 at surface 20 of the cover portion 11, when locking stud 15 is in a non-flexed condition. The locking stud 15 is for the most part cylindrically shaped but has the above-described oval-shaped head portion. A slot, void of material, is formed along a central axis of the locking stud to present two opposed and spaced semi-cylindrical portions having two opposed and spaced semi-oval head portions as best viewed in FIG. 6. In FIG. 6, interrupted lines 15*a* correspond to the cylindrical portion of the locking stud, and the accuate solid lines 15*b* correspond to the oval shaped head portion. Portions 15*a* and 15*b* are also indicated in FIG. 7. As best seen in FIG. 8, when cover portion 11 is being closed, the normally spaced semi-ovals of the head portion 19 are forced by receiving aperture 17 to be in contact with each other along their straight portions 15*c* to present a flexed generally circular head portion having a diameter slightly less than the diameter of the receiving aperture 17 at the surface 20 of the cover portion 11, thus enabling the head portion 19 to pass through the receiving aperture 17. FIG. 8 depicts a locking stud just prior to having the overlapping engagement, which is shown in FIG. 9.

The preferred polypropylene material of fabrication provides some flexibility to the locking studs. In order to more easily force the locking stud to transform from the condition whereat the semi-oval head portions are spaced to the condition whereat the semi-oval head portions are contacting each other, receiving aperture 17 is a truncated conical shape as best viewed in FIGS. 7–10. To increase the length of the truncated cone, so as to facilitate closing, an annular rib 21 is provided on the underside 22 of the cover portion 11. At the larger end of the truncated cone, the diameter is substantially equal to the length of the major axis of the oval head portion, and at the smaller end of the truncated cone the diameter is substantially equal to the length of the minor axis of the oval head portion. The length of the minor axis is also substantially equal to a decreased length of the major axis, when the locking stud is flexed for entry through receiving aperture 17, as indicated in FIG. 8. With such truncated conical configuration for the receiving aperture 17, the locking stud 15 can enter the receiving aperture 17 in a smooth manner and proceed along the length of the receiving aperture until the head portion passes completely past surface 20 at the smaller end. When that position is reached, because of the flexibility of the locking studs, the locking studs snap into their non-flexed shape, thus locking the cover closed, as best viewed in FIG. 9.

Figure 11:
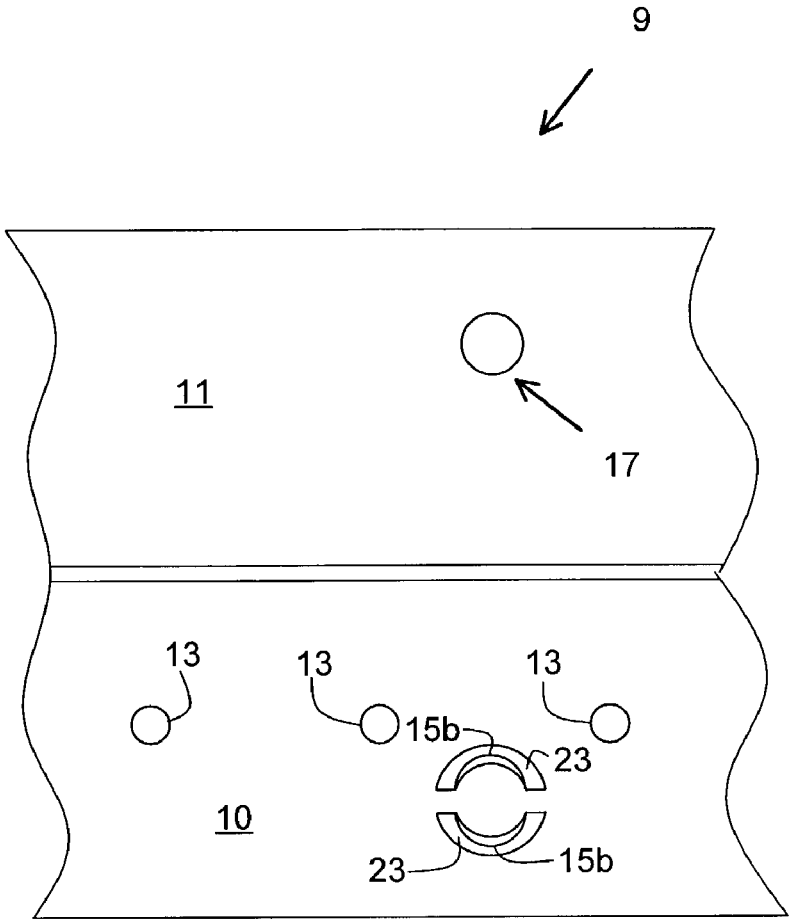
FIG. 11 is an enlarged back view of a portion of the hanger of the present invention in a fully open condition.

In addition to the semi-oval head portions and semi-cylindrical portions of the locking studs flexing toward each other during the closing operation, the locking stud as a whole can pivot from its normally perpendicular relationship to backing-plate portion 10. Such pivoting movement occurs as the locking stud is entering the receiving aperture 17 as shown in FIGS. 7 and 8. To better enable such pivoting movement for the locking stud as a whole, semi-annular openings 23 in the material of the backing-plate portion are provided at the base of the locking stud 15, as shown in FIGS. 6–11. The openings are generally of a semi-annular shape, that is, they are an annular shaped opening except for a narrow strip of backing-plate material which is present along a longitudinal axis 24 on which the studs and locking studs are located, as shown in FIG. 6. With such a configuration each locking stud can pivot, in a limited amount, in a less restrained manner than if no openings were present near the base of each locking stud. In a preferred embodiment, the width of the narrow strip of backing plate material corresponds to the width of the slot between the two semi-cylindrical portions of the locking stud as described above. FIG. 11, a back view of the hanger, shows the semi-annular openings in the backing-plate portion at 23.

As mentioned above the present invention is a single-piece molded plastic hanger, so as to provide for simplified installation and ease of maintaining the flexible strips supported by the hanger. Additionally, for sanitation reasons, the hanger has exterior surfaces which are smooth and easily cleaned, and which substantially enclose the cavity in which the flexible strips are located. A portion of the hanger which significantly contributes to those desired features is hinge portion 12 which extends continuously along the length of the hanger, as best viewed in FIGS. 2 and 3. The cross-sectional configuration of the hinge, in a plane perpendicular to its longitudinal axis, is best viewed in FIGS. 7—10 at numeric indicator 12. The hinge has a relatively heavy web at its connections with the backing-plate portion and the cover portion at 25 and 26 respectively. From those connecting points, the hinge tapers down to a thin web as indicated at 27, at which point the actual hinging action takes place in the polypropylene material. In the preferred embodiment, the thin web 27 has a thickness t in a range of 5–10 mils, and such thickness extends substantially uniformly between the two heavier web portions across a hinging axis to have a width w of about 10–15 mils. Such dimensions are best viewed in FIG. 10 at t and w respectively. The above preferred dimensions are based on use of the preferred polypropylene material. In tests of the present hanger, at temperatures found in freezers for frozen food, the web did not fracture after repeated openings and closings of the hanger. In order for the hanger to have such favorable properties at such freezing temperatures, which the hanger is often subjected to, steps must be carried out during the molding process, which are described below.

Figure 12:
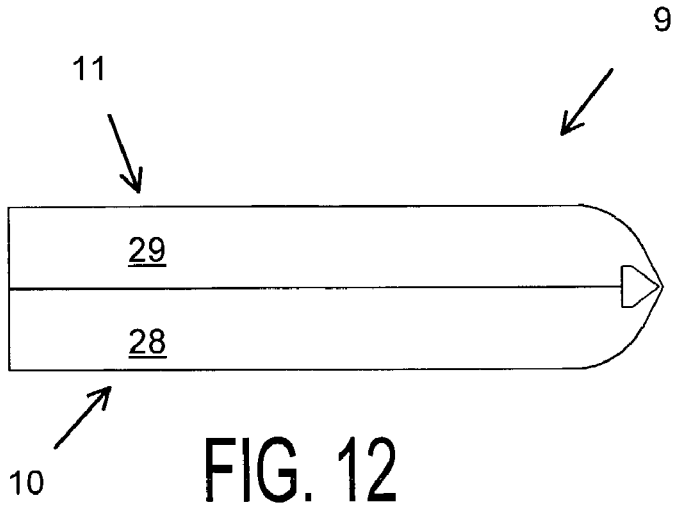
FIG. 12 is an end view of the hanger of the present invention in a fully closed condition.

Another feature of the hanger, which enhances its sanitary properties, is found at ends of the hanger, and is best viewed in FIGS. 5 and 12. Referring to FIG. 5, both the backing-plate portion 10 and the cover portion 11 of the hanger have end projections 28 and 29 respectively, extending toward each other so as to contact each other when the hanger is in a closed condition. As best seen in FIG. 12 ends of the hanger are sealed, except for a small portion near the hinge, so as to present a sanitary strip door installation.

As mentioned above, several steps must be carried out in the molding process to obtain a hinge portion of the hanger having the properties needed to provide a durable product. In the present invention, the preferred material of the hanger is polypropylene, and the preferred method of manufacturing is injection molding. Because of the length of the hinge portion (30–40 inches) and the thickness of the thin web portion 27 (5–10 mils), molding of a durable hinge can be difficult. Preferred conditions for molding are: a polypropylene material temperature, prior to molding, of about 550° F. and a molding pressure of about 750 PSI, with entry of material into the mold at a plurality of locations along both the backing-plate portion and the cover portion; and, following the injection of the polypropylene molding material, the molded hanger is removed quickly from the mold when the polypropylene molded material is at a temperature in a range of 150° F. to 200° F., and the hanger is pivoted a number of times about the axis of the hinge, in a range from the as-molded open condition of the hanger, to a nearly closed condition of the hanger (when cover portion 11 just contacts locking studs 15 as shown in FIG. 7). Such pivoting affects the structure of the polypropylene in the area of the thin web section 27 of the hinge, and thus results in a more durable hinge as discussed above. Without such molding step, the hinge does not have the above-described durable properties and in most cases will fracture during use at the typical low temperatures of use described above.

While specific materials, dimensional data, fabricating steps, etc., have been set forth for purposes of describing embodiments of the invention, various modifications can be resorted to, in light of the above teachings, without departing from the novel contributions; therefore in determining the scope of the present invention, reference shall be made to the appended claims.

What is claimed is:

1. A single-piece molded plastic hanger for use in a strip door system for providing a barrier in a vertical plane of an opening, said hanger for supporting vertically hanging flexible plastic strips, each strip having a row of uniformly spaced apertures along an upper end portion, said single-piece molded plastic hanger comprising an elongated backing-plate portion for attaching said hanger to a header of the opening, said backing-plate portion having a plurality of means for supporting said vertically hanging plastic strips, an elongated cover portion, for retaining said strips on said supporting means when in a closed condition, and an elongated continuous hinge portion connecting a longitudinal edge of said backing-plate portion and a longitudinal edge of said cover portion to enable movement of the cover portion to an opened and the closed condition, wherein a plurality of said supporting means engage said cover portion when rotated to the closed condition, to maintain said cover portion in said closed condition, and said means for supporting said plastic strips include a plurality of protruding supporting studs and a plurality of protruding locking studs arranged along a longitudinal axis of said backing-plate portion, said supporting studs and said locking studs having a spacing corresponding to the spacing of said uniformly spaced apertures of said flexible plastic strips, said locking studs engaging said cover portion to maintain said cover portion in said closed condition.

2. The single-piece molded plastic hanger as defined in claim 1, wherein said hanger is molded of polypropylene.

3. The single-piece molded plastic hanger as defined in claim 2, wherein said hinge portion includes a thin web at which a hinging action occurs, and said thin web is of a thickness between 5 and 10 mills and extends across a hinging axis for a width of between 10 and 15 mils.

4. The single-piece molded plastic hanger as defined in claim 1, wherein said backing-plate portion has therein countersunk apertures for mounting said hanger to a header of said opening.

5. The single-piece molded plastic hanger as defined in claim 1, wherein said supporting studs are of a cylindrical configuration and are slidingly received by mating receiving recesses in an inner face of said cover portion when said cover portion is rotated to the closed condition, said locking studs are of a cylindrical configuration with an enlarged head portion, and are slidingly received by receiving apertures in said cover portion, and said cover is restrained in said closed condition by overlapping of a portion of said head portion on said cover portion.

6. The single-piece molded plastic hanger defined in claim 5, wherein said receiving aperture is of a truncated conical shape having a larger diameter end facing said backing-plate portion when in a closed condition and a smaller diameter end, said locking stud defines a slot of selected width extending along a central axis of said locking stud which is void of material, said head portion of said locking stud is of an oval shape in cross-section, having a minor axis, and a major axis being substantially equal to said larger diameter of said truncated cone, said cylindrical portion diameter of said locking stud is substantially equal to said truncated cone smaller diameter, wherein when said locking stud is inserted into said receiving aperture during a closing operation, said locking stud flexes to substantially eliminate said slot thus reducing a length of said major axis to be substantially equal to said truncated cone smaller diameter, to enable said head portion to pass completely through said receiving aperture, at which point said locking stud returns to a non-flexed shape causing a portion of said head portion to overlap said cover portion and thus restrain the cover portion in the closed condition.

7. The single-piece molded plastic hanger defined in claim 6, wherein said backing-plate portion defines semi-annular openings in a portion of said backing plate partially surrounding said locking studs, to facilitate pivoting of said locking studs during engagement with said receiving apertures when rotating said cover portion to the closed condition.

8. The single-piece molded plastic hanger defined in claim 1, wherein respective ends of said backing-plate portion and said cover portion sealingly contact each other when said cover portion is in said closed condition.

9. The single-piece molded plastic hanger defined in claim 5, wherein said receiving recesses for said supporting studs and said receiving apertures for said locking studs include an annular reinforcing portion on the inner face of said cover portion.

10. A method of forming a single-piece molded plastic hanger, for use in a strip door system to support vertically hanging flexible plastic strips, each strip having a row of uniformly spaced apertures along an upper end portion, said method comprising providing an injection mold for molding a single-piece plastic hanger having an elongated backing-plate portion, an elongated cover portion, and an elongated hinge portion connecting a longitudinal edge of said backing-plate portion and a longitudinal edge of said cover portion, injecting plastic material, at a temperature of about 550° F., into said injection mold, to form said plastic hanger, removing said formed single-piece plastic hanger from said injection mold when the temperature of said plastic hanger is in a range of 150° F. to 200° F., and while at a temperature within said range, pivoting said backing-plate portion and said cover portion about said hinge portion a plurality of times.

11. The method of forming the single-piece molded plastic hanger defined in claim 10, wherein said plastic material is polypropylene.

* * * * *